US009797100B1

(12) United States Patent
Muir et al.

(10) Patent No.: US 9,797,100 B1
(45) Date of Patent: Oct. 24, 2017

(54) MILLING MACHINE

(71) Applicant: Caterpillar Paving Products Inc., Brooklyn Park, MN (US)

(72) Inventors: Jason W. Muir, Andover, MN (US); Brian J. Schlenker, Shoreview, MN (US); Matthew-David S. Frantz, Shakopee, MN (US); Derek P. Nieuwsma, Maple Grove, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 15/161,415

(22) Filed: May 23, 2016

(51) Int. Cl.

| | |
|---|---|
| ***E01C 23/00*** | (2006.01) |
| ***E01C 23/06*** | (2006.01) |
| ***E01C 21/00*** | (2006.01) |
| ***E01C 23/088*** | (2006.01) |
| ***E01C 23/12*** | (2006.01) |
| ***E02D 3/00*** | (2006.01) |

(52) U.S. Cl.
CPC ..... *E01C 23/065* (2013.01); *E01C 21/00* (2013.01); *E01C 23/088* (2013.01); *E01C 23/127* (2013.01); *E02D 3/005* (2013.01)

(58) Field of Classification Search
CPC ..... E01C 21/00; E01C 23/065; E01C 23/088; E01C 23/127; E02D 3/005
USPC ..... 404/84.05, 90, 92
See application file for complete search history.

(56) References Cited

U.S. PATENT DOCUMENTS

| | | | | |
|---|---|---|---|---|
| 4,678,236 | A | 7/1987 | Wirtgen | |
| 6,152,648 | A | 11/2000 | Gfroerer et al. | |
| 8,424,972 | B2 | 4/2013 | Berning et al. | |
| 8,610,674 | B2 | 12/2013 | Pryor | |
| 8,764,341 | B2 | 7/2014 | Menzenbach et al. | |
| 8,851,792 | B1 | 10/2014 | Schlenker et al. | |
| 2016/0040372 | A1* | 2/2016 | Eiden | E01C 23/088 29/426.1 |

FOREIGN PATENT DOCUMENTS

| | | |
|---|---|---|
| CN | 216479 | 4/1995 |
| CN | 103510455 | 1/2014 |

* cited by examiner

*Primary Examiner* — Raymond W Addie

(57) ABSTRACT

A milling machine has a frame, a rotor, a mixing chamber with a front door and a rear door, and a controller. The controller is in communication with the frame, the rotor, the front door, and the rear door, and configured to operate the milling machine in a travel mode and a work mode. When the travel mode is actuated, the controller raises the rotor to a predetermined position, closes the front door and the rear door, and raises the frame to a predetermined height. When the work mode is actuated, the controller lowers the frame to a predetermined height, lowers the rotor to a predetermined position, and opens the front door and the rear door to predetermined positions.

20 Claims, 7 Drawing Sheets

MILLING MACHINE

TECHNICAL FIELD

The present disclosure relates generally to operation of a milling machine and, more particularly, to a system and a method for operating the milling machine by automatically controlling machine functions when the machine switches between a travel mode and a work mode.

BACKGROUND

Milling machine are used in a variety of applications including removing material off a ground surface, stabilizing soil, surface mining, and mixing milled materials into a ground surface, among other things. These milling machines include rotary mixers and cold planers. Rotary mixers, in particular, are used to pulverize a ground surface, such as roadways based on asphalt, and mix a resulting pulverized layer with an underlying base, to stabilize the ground surface. Rotary mixers may also be used as a soil stabilizer to cut, mix, pulverize, and stabilize a soil surface, for attaining a strengthened soil base. Optionally, rotary mixers may add asphalt emulsions or other binding agents during pulverization to create a reclaimed surface.

A rotary mixer includes a frame, lifting columns that alter the height of the frame relative to the ground surface, a mixing chamber, and a rotor within the mixing chamber that is also height adjustable. The mixing chamber also includes a front door and a rear door. The front door and the rear door are used to control the amount of material entering the mixing chamber, the amount of material leaving the mixing chamber, and the degree of pulverization of the material within the mixing chamber, among other things.

On a worksite, a rotary mixer will typically perform multiple milling passes over a work area. To perform a milling pass, an operator generally executes a sequence of operations involving positioning the machine frame, the rotor, the front door, and the rear door to desired positions. These components are controlled by separate operator initiated control commands. After the completion of a milling pass, the rotary mixer typically needs to be repositioned before it can commence another milling pass. During maneuvering, the rotary mixer operator will generally reposition the machine frame, the rotor, the front door, and the rear door. When the rotary mixer is in position for the second milling pass, the operator will again move the frame, the rotor, the front door, and the rear door to the desired milling positions.

Manually controlling these functions may result in inconsistent transitions and increasing the time necessary to prepare a work site. Separately controlling each function may also be cumbersome for the operator and may reduce productivity.

U.S. Pat. No. 8,424,972 (972 reference) discloses a control device automatically controlling a lifting operation of at least one rear and/or front lifting column to position the machine frame parallel to ground using sensors. The control device of the '972 reference controls the machine frame at a predetermined milling level, parallel to the ground. However, the '972 reference fails to discuss providing a simplified transition between different rotary mixer operating modes.

SUMMARY OF THE INVENTION

In an aspect of the present disclosure, a milling machine is disclosed. The milling machine has a frame, a rotor, a mixing chamber with a front door and a rear door, and a controller. The controller is in communication with the frame, the rotor, the front door, and the rear door, and configured to operate the milling machine in a travel mode. When the travel mode is actuated, the controller raises the rotor to a first predetermined position, closes the front door and the rear door, and raises the frame to a first predetermined height.

In another aspect of the present disclosure, a control system for a milling machine is disclosed. The milling machine has a frame, a rotor, and a mixing chamber with a front door and a rear door. The control system includes a controller configured to activate a travel mode by raising the rotor to a first predetermined position, closing the front door and the rear door, and raising the frame to a first predetermined height. The controller is also configured to activate a work mode by lowering the frame to a second predetermined height, lowering the rotor to a second predetermined position, and opening the front door to a third predetermined position and the rear door to a fourth predetermined position.

In yet another aspect of present disclosure, a method for operating a milling machine is disclosed. The method includes activating a work mode, lowering a frame to a first predetermined height, lowering a rotor to a first predetermined position, and opening a front door to a second predetermined position and a rear door to a third predetermined position.

DETAILED DESCRIPTION

Reference will now be made in detail to the embodiments of the disclosure, examples of which are illustrated in the accompanying drawings. Wherever possible, the same reference number will be used throughout the drawings to refer to the same or like parts.

Figure 1:
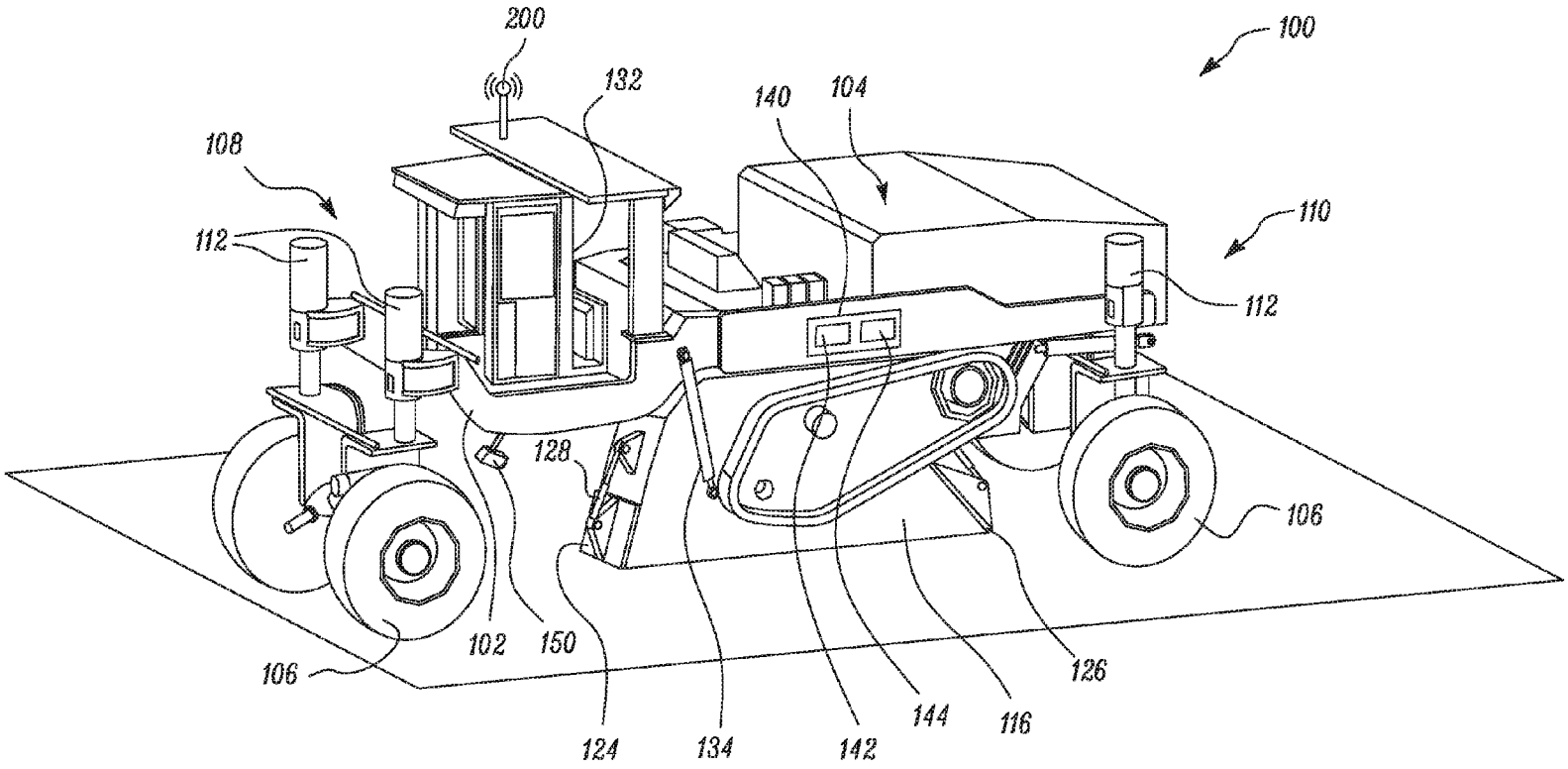
FIG. 1 illustrates perspective view of a milling machine in a travel mode.

FIG. 1 illustrates an exemplary milling machine 100. Although the milling machine 100 is shown as a rotary mixer, other machines for road reclamation, soil stabilization, surface pulverization, or other applications, may be used, such as a cold planer. The milling machine 100 includes a frame 102, an engine 104 supported on the frame 102, and one or more traction devices 106. The traction devices 106 are operatively coupled to the engine 104 by a transmission mechanism (not shown) to drive the traction devices 106 and propel the milling machine 100. Although, the traction devices 106 are shown as wheels, the traction devices 106 could alternatively be tracks, or a combination of both tracks and wheels.

The frame 102 includes a front portion 108 and a rear portion 110. The rear portion 110 supports the engine 104.

Further, the frame 102 is supported by lifting columns 112 at the front portion 108 and rear portion 110. The lifting columns 112 couple the traction devices 106 to the frame 102.

The lifting columns 112 allow an adjustment of a height, grade, and slope of the frame 102 relative to a ground surface. Accordingly, the frame 102 is adjusted relative to the ground surface. In a preferred embodiment, the lifting columns 112 may be actuated hydraulically. The lifting columns 112 include a first positioning module configured to determine the position of the lifting columns 112, and also determine the height, grade, and slope of the frame 102 relative to the ground surface.

The frame 102 is further connected to a mixing chamber 116. The mixing chamber 116 is located proximate to a center portion of the milling machine 100. While generally the lifting columns 112 will be actuated to maintain the frame 102 and therefore the mixing chamber 116 parallel to the ground surface, the operator may actuate the lifting columns to achieve any desired frame 102 and mixing chamber 116 orientation relative to the ground surface. The mixing chamber 116 includes a spray system 160, a front door 124, and a rear door 126. The spray system 160 delivers water, emulsion, foam asphalt, or other application into the mixing chamber 116. The spray system 160 includes plurality of nozzles for delivery of water and/or emulsion.

The rotor 122 is positioned in the mixing chamber 116. The rotor 122 is configured to break and pulverize the surface layer. The rotor 122 is vertically adjustable within the mixing chamber 116 with the help of a first actuator 134. The first actuator 134 is configured to adjust the height of the rotor relative to the ground surface. The first actuator 134 includes a second positioning module configured to determine the position of the rotor 122 relative to the ground surface.

The front door 124 is located at a front end of the mixing chamber 116. The front door 124 allows entry of ground surface particles into the mixing chamber 116. A second actuator 128 is connected to the front door 124 and is configured to raise or lower the front door 124 in an open position and a close position, respectively. A position of the front door 124 affects a degree of pulverization by regulating an amount, direction, and speed, of a material flow into the mixing chamber 116. The second actuator 128 includes a third positioning module configured to determine the position of the front door 124.

The rear door 126 is positioned at a rear end of the mixing chamber 116. The rear door 126 allows exit of the pulverized particles to form a pulverized surface. A third actuator 130 is connected to the rear door 126 and is configured to raise or lower the rear door 126 in an open position and a close position respectively. The position of the rear door 126 affects the degree of pulverization by regulating the amount and direction of the material flow through the mixing chamber 116. The third actuator 130 includes a fourth positioning module configured to determine the position of the rear door 126.

Figure 3:
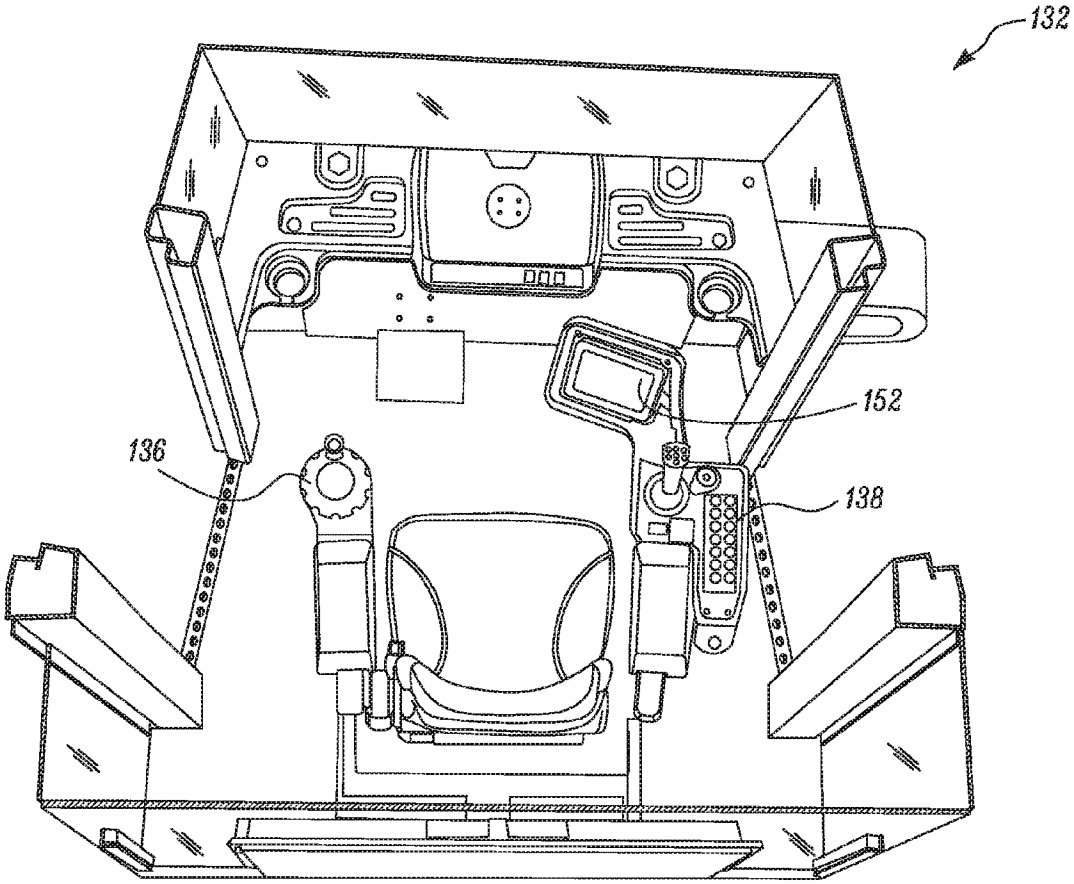
FIG. 3 illustrates an interior view of an operator control station of the milling machine.

The operator control station 132 is supported on the frame 102. The operator control station 132 includes a variety of components and controls units required for operating the milling machine 100. As illustrated in FIG. 3, the operator control station 132 includes a steering system 136 and a display unit 152. The steering system 136 may include a steering wheel, a joystick, or a lever. The operator control station 132 further includes an operator interface or operator input 138. The operator control station 132 may include various other control input systems for controlling various other operational parameters, such as engine speed, water/emulsion delivery system, and/or rotor speed of the milling machine 100. The operator interface 138 may be an operator control button, a toggle switch, a touch panel, a rotary switch, a radial dial, a switch, or any other device known in art.

The operator interface 138 is configured to activate a work mode to perform a cutting action on the ground surface, upon receiving a command signal from the operator. The operator interface 138 is further configured to activate a travel mode upon receiving a command signal from the operator. In that way, the operator interface 138 is configured to switch the milling machine 100 between the work mode and the travel mode. The operator interface 138 is communicably coupled to a controller 140.

Figure 6:
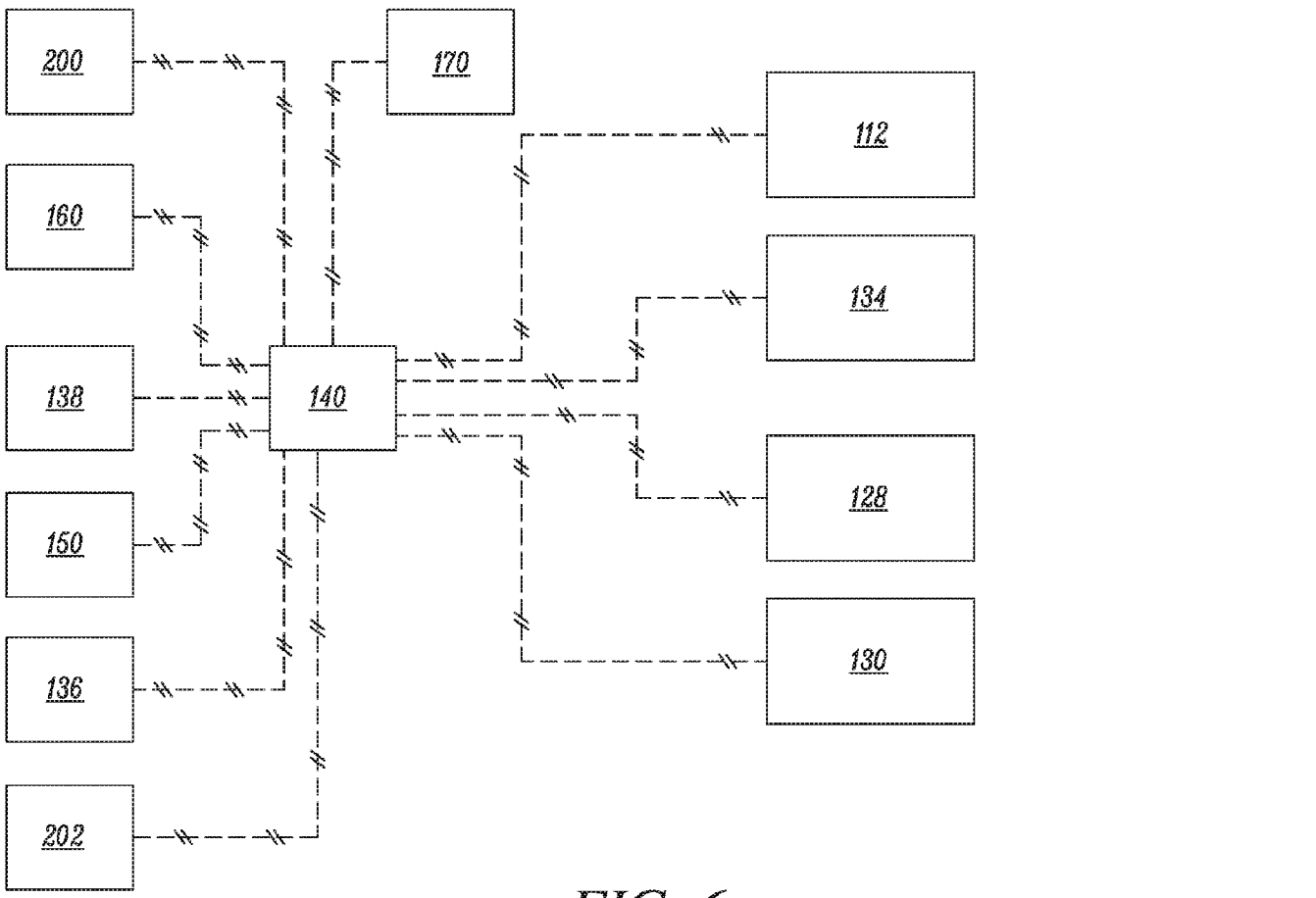
FIG. 6 illustrates a schematic view of a control system of the milling machine.
Figure 7:
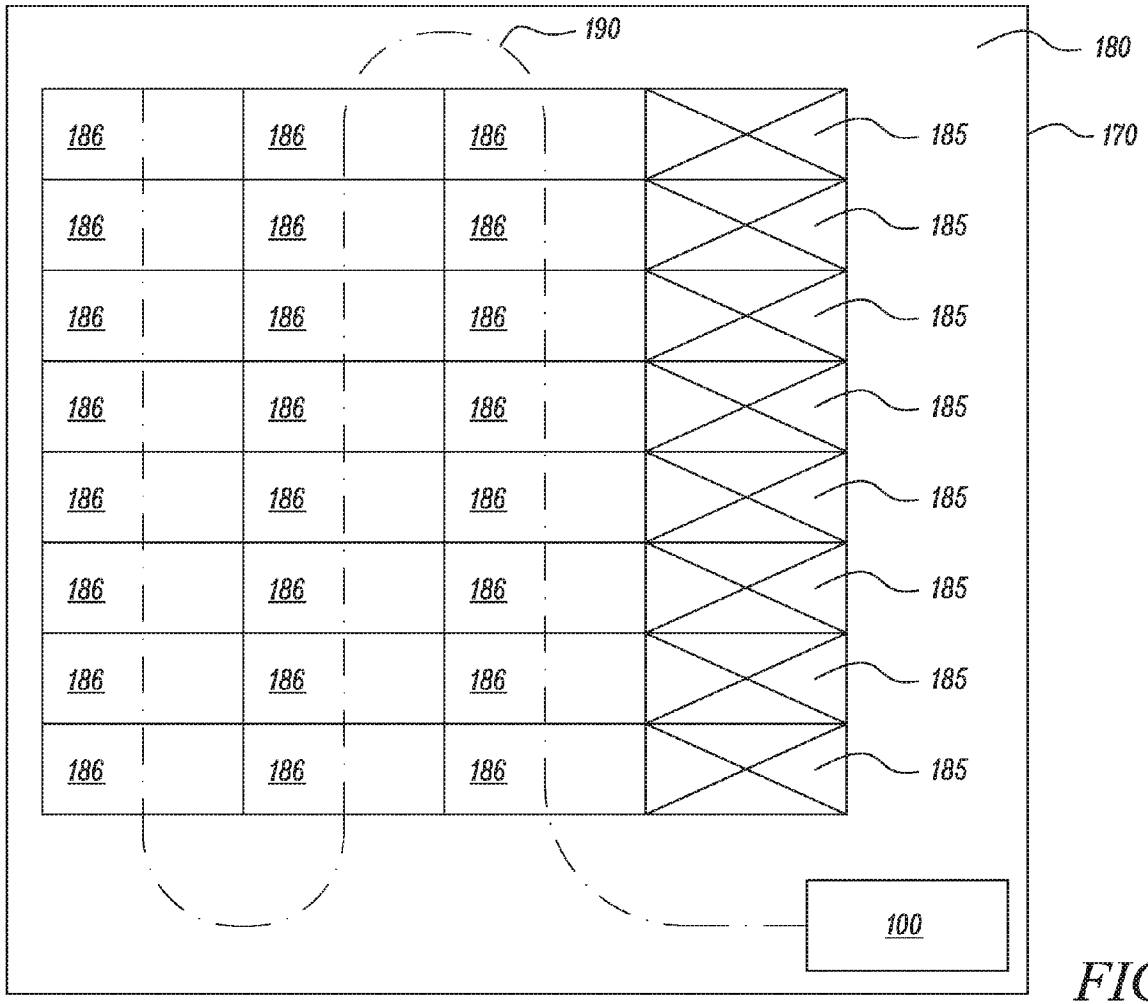
FIG. 7 illustrates a map depicting a jobsite on which milling machine is operated.

The controller 140 may be a microprocessor or any other electronic device configured to control a plurality of devices. In an embodiment, the controller 140 may be an electronic control module (ECM). As shown in FIG. 6, the controller 140 may be configured to receive signals from various electronic devices, such as the first positioning module, the second positioning module, the third positioning module, the fourth positioning module, and the operator interface 138. In an alternate embodiment, the controller 140 may also be configured to transmit signals to various devices, but not limited to, the lifting columns 112, the rotor 122, the first actuator 134, the second actuator 128, the third actuator 130 and the spray system 160. In the embodiment illustrated, the controller 140 may be located on the milling machine 100, although it could also be located at a remote location. The controller 140 may include a memory unit 142 and a processing unit 144.

The memory unit 142 may include one or more storage devices configured to store information used by the controller 140. In an embodiment, the operator may store the desired position of the frame 102 and the rotor 122 in the memory unit 142 to set the milling depth, as per the nature of the milling operation. The operator may also store the desired position of the front door 124 and the rear door 126 according to the degree of pulverization required in the memory unit 142.

The processing unit 144 may include one or more known processing devices, such as a microprocessor or any other device known in the art. In the embodiment illustrated, the memory unit 142 and the processing unit 144 may be combined into in a single unit. In an alternate embodiment, the memory unit 142 and processing unit 144 may be incorporated into the milling machine 100 separately.

Figure 4:
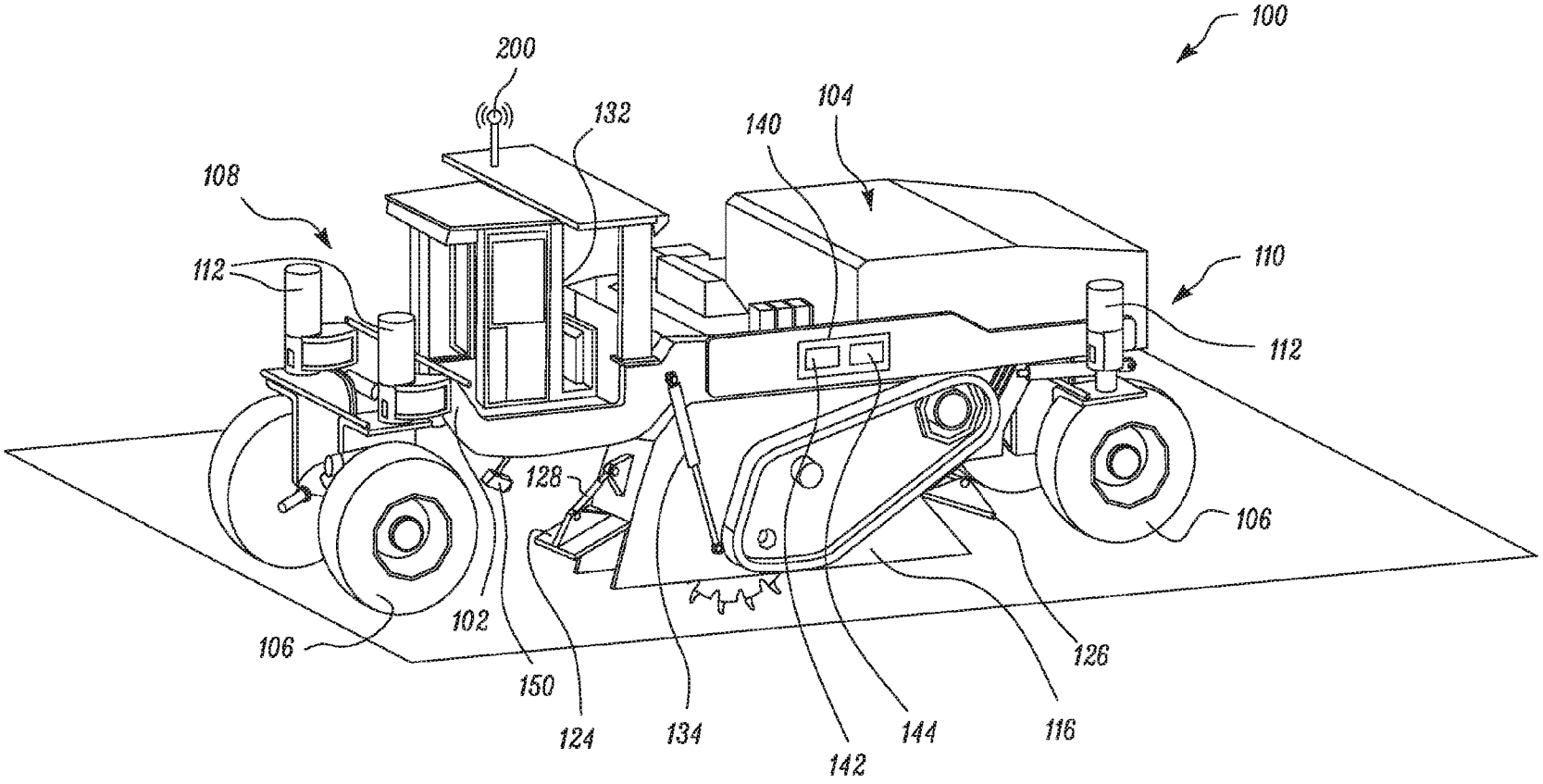
FIG. 4 illustrates a perspective view of the milling machine in a work mode.
Figure 5:
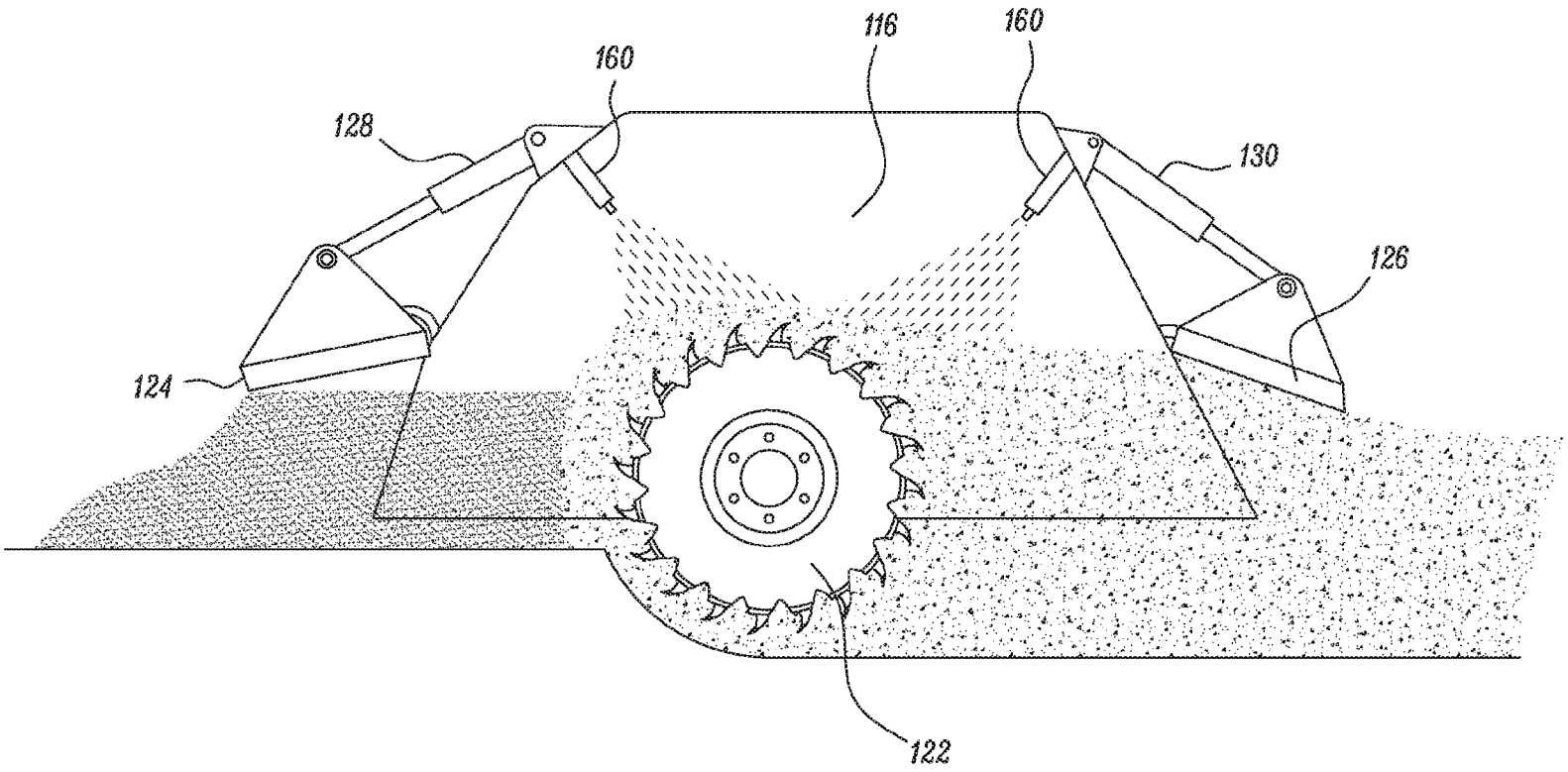
FIG. 5 illustrates the mixing chamber of the milling machine in the work mode.

As illustrated in FIG. 4 and FIG. 5, the milling machine 100 is shown in a work mode. Upon actuation of the work mode, the controller 140 is configured to lower the frame 102 to the lowered position. When the frame 102 is lowered, the controller 140 is configured to position the rotor 122 to the lowered position relative to the frame 102. Further, the controller 140 is configured to open the front door 124 and the rear door 126 when the rotor 122 is in the lowered position. These functions are executed upon receiving the cut command from the operator interface 138.

Figure 2:
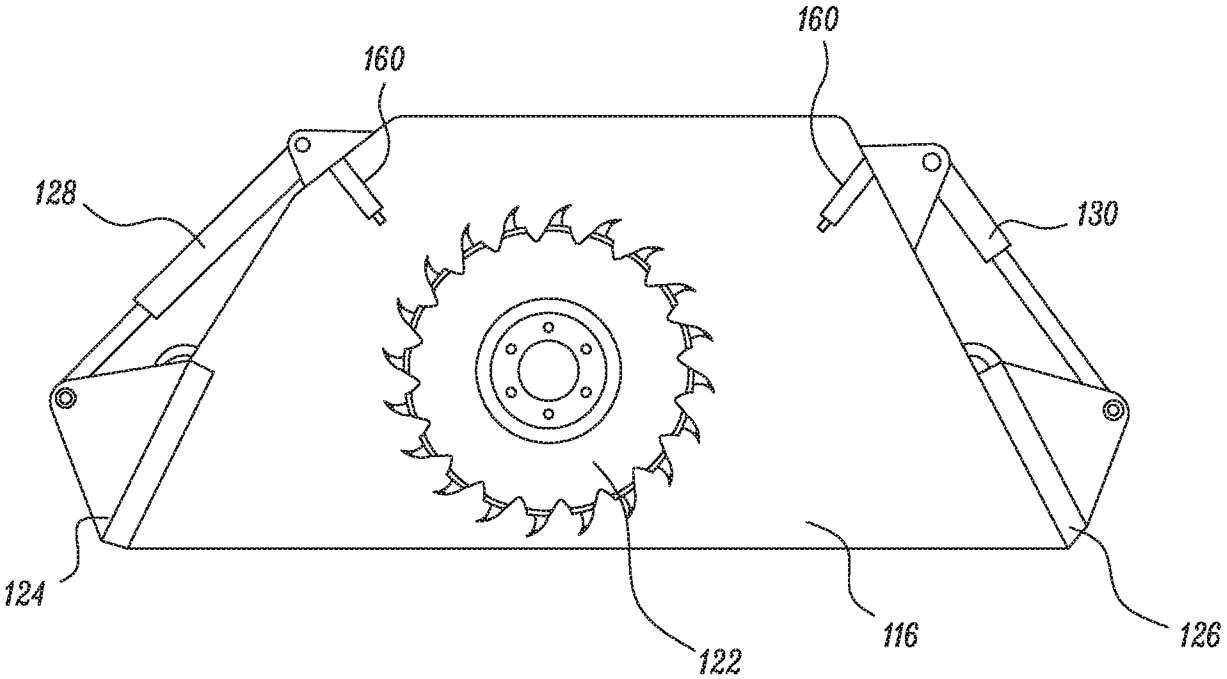
FIG. 2 illustrates a mixing chamber of the milling machine in the travel mode.

As illustrated in FIG. 1 and FIG. 2, the milling machine 100 is shown in a travel mode. Upon actuation of the travel mode, the controller 140 is configured to raise the rotor 122 to the raised position. When the rotor 122 is raised to the raised position, the front door 124 and rear door 126 are closed. Once the front door 124 and rear door 126 are closed, the controller 140 is further configured to raise the frame 102 to the raised position. The above mentioned functions are also executed upon receiving the travel command from the operator interface 138. The controller 140 determines, with the help of positioning modules, the position of the frame 102, the rotor 122, the front door 124 and the rear door 126.

The controller 140 further compares the current position of the frame 102, the rotor 122, the front door 124 and the rear door 126 with the predetermined position. For example, during the work mode, the rotor 122 may be moved to a predetermined depth. The first positioning module may determine whether the desired position is achieved. Once the desired position is achieved, the first positioning module may transmit a signal to apprise the controller 140 of the attainment of the desired position, as shown in FIG. 6. The controller 140 may limit a further travel of the rotor 122.

In an embodiment, the controller 140 may itself determine a sequence of the above mentioned functions, perhaps according to the working conditions. Logic required for such determination may be stored in the memory unit 142. In an alternate embodiment, the sequence may be altered according to the working conditions as perceived by the operator. The operator interface 138 and the controller 140 together form a control system 146 (shown in FIG. 6). In addition, the control system 146 also includes the steering system 136, a map 170, a location sensor 200, and a speed sensor 202.

It may also be possible to selectively control various operational parameters such as an engine speed, a machine speed, a steering control mode, and a rotor speed, besides activation of the work mode and the travel mode for attaining a desired surface. For example, when the work mode is activated, the controller 140 may control the operational parameters of the milling machine 100 along with controlling the milling operations as set by the operator.

Additionally or optionally, the controller 140 may control the spray system 160 according to operation of the milling machine 100 in the travel mode or the work mode. When the milling machine 100 is operating in the work mode, the controller 140 activates the spray system 160 for delivery of an application such as water, emulsion, foam asphalt, or many other applications known in the art into the mixing chamber 116. The controller 140 may also control the amount of application delivered into the mixing chamber 116. Further, when the milling machine 100 is operating in the travel mode, the controller 140 deactivates the spray system 160 to stop the delivery of the application into the mixing chamber 116.

In an embodiment, as shown in FIG. 1, the milling machine 100 further includes multiple cameras 150 and mounted to the frame 102. The cameras 150 may be adjusted in various orientations to provide different views of the mixing chamber 116 and/or surrounding of the milling machine 100. The controller 140 may also adjust the camera 150 view upon actuation of the work mode or the travel mode. For example, when the milling machine 100 is in work mode, the controller 140 adjusts the camera 150 such that a visual data of the mixing chamber 116 is reproduced on the display unit 152. Further, when the milling machine 100 is operating in the travel mode, the controller 140 adjusts the camera 150 such that the visual data of surroundings of the milling machine 100 is reproduced on the display unit 152.

In an embodiment, the display unit 152 may be communicably coupled to the controller 140. In an alternate embodiment, the display unit 152 may be in communication with the controller 140 using a wired connection (not shown). In another embodiment, the display unit 152 may be any portable device, wirelessly connected to the controller 140, and which may be operated by a personnel present outside the milling machine 100. The display unit 152 is configured to display the view captured by the camera 150. In the illustrated embodiment, the display unit 152 may be included in the operator control station 132. In an alternate embodiment, the display unit 152 may be positioned at a remote location for remotely controlling the milling machine 100.

In an embodiment, the display unit 152 may include a touch panel. In such cases, the operator may control the various functions of the milling machine 100 by performing a touch operation or a gesture operation. For example, the operator may provide commands, via touch panel of the display unit 152, to control the position of the frame 102, the rotor 122, the front door 124, the rear door 126, spray system 160 and orientation of the cameras 150. The operator may input the desired position of the frame 102, the rotor 122, front door 124 and the rear door 126 according to the degree of pulverization required. The operator may also input the amount of water and/or emulsion to be delivered by the spray system 160. Further, the operator may also input the angle at which the camera 150 would provide required view of the mixing chamber 116 and the ground surface. These inputs may be stored in the memory unit 142 for future reference.

INDUSTRIAL APPLICABILITY

The present disclosure finds potential application in any milling machine, and in particular, rotary mixers. The present disclosure assists in enabling jobsite productivity and smooth transitions when the milling machine 100 moves into a travel mode from a work mode, and a work mode into a travel mode.

When entering either the travel mode or the work mode, the machine will actuate and move the rotor 122, the front door 124, the rear door 126, and the frame 102. The rotor 122 will have a predetermined position associated with the travel mode and a predetermined position associated with the work mode. Similarly, the front door 124 and the rear door 126 will have a closed position and a predetermined open position. The frame 102 will also have a predetermined height associated with the travel mode and a predetermined height associated with the work mode. These predetermined positions and heights may either be preprogrammed or set by the operator. They may also be adjusted during machine operation by the operator, a jobsite manager, another individual supervising the machine operation, or by the milling machine 100 itself.

The milling machine 100 has a controller 140 which receives a signal to activate the travel mode. Upon receipt of the signal to activate that travel mode, the controller 140 moves the rotor 122 to a predetermined position. After the rotor 122 reaches the predetermined position, the controller 140 closes the front door 124 and the rear door 126. After the front door 124 and the rear door 126 are closed, the controller 140 raises the frame 102 to a predetermined height.

The controller 140 also receives a signal to activate the work mode. Upon receipt of the signal to activate the work mode, the controller 140 lowers the frame 102 to a predetermined height. After the frame 102 reaches the predetermined height, the controller 140 moves the rotor 122 to a predetermined position. After the rotor 122 reaches the predetermined position, the controller 140 opens the front door 124 and the rear door 126 to predetermined positions.

The milling machine 100 may also include mapping functionality that the controller 140 would communicate with. The map 170 would display locations 186 on a jobsite 180 that the milling machine 100 would need to process, locations 185 that the milling machine 100 had already processed, and locations that do not need to be processed. The location sensor 200 would show the position of the milling machine 100 on the jobsite 180. The controller 140 would calculate a travel path 190 for the milling machine 100 on the jobsite 180 that would optimize efficiency and minimize the number of passes milling machine 100 would have to make over the jobsite 180. The map 170 would also allow the travel mode and work mode to be automatically entered into based on the machine position and knowing the locations 186 to be processed. When the milling machine 100 moves to an area on the jobsite 180 indicated as needing to be processed, the controller 140 would activate the work mode. Similarly, when the milling machine 100 moves from an area that needs to be processed to an area that does not need to be processed or has already been processed, the controller 140 would activate the travel mode.

Other functions may also be tied to whether the milling machine 100 is in the work mode or the travel mode. For example, the spray system 160 may activate when in the work mode and deactivate when in the travel mode. Steering system 136 may be limited in movement during the work mode and not in the travel mode. The speed of milling machine 100 may be limited when in the work mode and not in the travel mode. The speed of the milling machine 100 may be determined by the speed sensor 202. The engine load of the milling machine 100 may be controlled at various settings depending whether the milling machine 100 is in the work mode or the travel mode. Cameras 150 may be active during the work mode but not during the travel mode. Different lights on the milling machine 100 may be active depending on whether the milling machine 100 is in the work mode or the travel mode. Other functions may also be tied to the work mode and the travel mode.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A milling machine, comprising:
a frame;
a rotor;
a mixing chamber having a front door and a rear door; and
a controller in communication with the frame, the rotor, the front door, and the rear door, and configured to operate the milling machine in a travel mode, wherein upon actuation of the travel mode, the controller is configured to:
raise the rotor to a first predetermined position;
when the rotor reaches the first predetermined position, close the front door and the rear door; and
when the front door and the rear door are closed, raise the frame to a first predetermined height.

2. The milling machine of claim 1, wherein the controller is further configured to operate the milling machine in a work mode, wherein upon actuation of the work mode, the controller is configured to:
lower the frame to a second predetermined height;
when the frame reaches the second predetermined height, lower the rotor to a second predetermined position; and
when the rotor reaches the second predetermined position, open the front door to a third predetermined position and the rear door to a fourth predetermined position.

3. The milling machine of claim 2, further comprises an operator input to switch between the travel mode and the work mode.

4. The milling machine of claim 2, further comprises a location sensor and a map of a jobsite on which the milling machine is operating, wherein the map includes a plurality of locations to be processed by the milling machine.

5. The milling machine of claim 4, wherein the controller is further configured to determine a travel path for the milling machine to process the plurality of locations.

6. The milling machine of claim 5, wherein the controller is further configured to switch between the travel mode and the work mode based on the travel path, the map, and the location sensor.

7. The milling machine of claim 2, further comprising a spray system to deliver an application, wherein the controller is configured to activate the spray system in the work mode and deactivate the spray system in the travel mode.

8. The milling machine of claim 2, further comprising a steering system, wherein the controller is configured to limit the steering system in the work mode.

9. A control system for a milling machine, the milling machine having a frame, a rotor, and a mixing chamber with a front door and a rear door, the control system comprising:
a controller configured to:
activate a travel mode by:
raising the rotor to a first predetermined position;
when the rotor reaches the first predetermined position, closing the front door and the rear door; and
when the front door and the rear door are closed, raising the frame to a first predetermined height; and
activate a work mode by:
lowering the frame to a second predetermined height;
when the frame reaches the second predetermined height, lowering the rotor to a second predetermined position; and
when the rotor reaches the second predetermined position, opening the front door to a third predetermined position and the rear door to a fourth predetermined position.

10. The control system of claim 9, further comprising an operator input to switch between the travel mode and the work mode.

11. The control system of claim 9, further comprising a location sensor configured to indicate a machine position on a jobsite, wherein the controller receives the machine position and activates the travel mode based on the machine position.

12. The control system of claim 11, wherein the controller activates the work mode based on the machine position.

13. The control system of claim 12, further comprising a speed sensor configured to indicate a machine speed, wherein the controller prevents the machine speed from exceeding a predetermined machine speed when the milling machine is in the work mode.

14. The control system of claim 12, further comprising a map of the jobsite displaying the machine position and a plurality of locations that need to be processed by the milling machine.

15. The control system of claim 14, further comprising a steering system and wherein the controller determines a travel path for the milling machine based on the machine location and the plurality of locations, and the controller controls the steering system along the travel path.

16. A method for operating a milling machine, the method comprising:

activating a work mode;

when the work mode is activated, lowering a frame to a first predetermined height;

when the frame reaches the first predetermined height, lowering a rotor to a first predetermined position; and when the rotor reaches the first predetermined position, opening a front door to a second predetermined position and a rear door to a third predetermined position.

17. The method of claim 16, further comprising:

activating a travel mode;

when the travel mode is activated, raising the rotor to a second predetermined position;

when the rotor reaches the second predetermined position, closing the front door and the rear door; and when the front door and the rear door are closed, raising the frame to a second predetermined height.

18. The method of claim 17, further comprising activating the travel mode or the work mode based on a machine location.

19. The method of claim 18, further comprising controlling a machine speed when the work mode is active.

20. The method of claim 19, further comprising controlling a machine engine load when the work mode is active.

* * * * *